US006186041B1

(12) United States Patent
Menges

(10) Patent No.: US 6,186,041 B1
(45) Date of Patent: Feb. 13, 2001

(54) BREECHBLOCK OPENING AND CLOSING DEVICE FOR A LARGE-CALIBER WEAPON

(75) Inventor: Horst Menges, Ratingen (DE)

(73) Assignee: Rheinmetall W & M GmbH, Unterlüss (DE)

( * ) Notice: Under 35 U.S.C. 154(b), the term of this patent shall be extended for 0 days.

(21) Appl. No.: 09/245,923

(22) Filed: Feb. 8, 1999

(30) Foreign Application Priority Data

Feb. 6, 1998 (DE) ..... 198 04 653

(51) Int. Cl.[7] ..... F41A 3/00
(52) U.S. Cl. ..... 89/24; 89/17
(58) Field of Search ..... 89/24, 17

(56) References Cited

U.S. PATENT DOCUMENTS 4,462,299 * 7/1984 Grunewald et al. ..... 89/24
6,006,645 * 12/1999 Breuer et al. ..... 89/24

FOREIGN PATENT DOCUMENTS 31 42 457 5/1983 (DE) .

* cited by examiner

*Primary Examiner*—J. Woodrow Eldred
(74) *Attorney, Agent, or Firm*—Venable; Gabor J. Kelemen

(57) ABSTRACT

A weapon includes a barrel; a breech ring attached to a rearward end of the barrel; a groove provided in the breech ring; a movable breechblock mounted in the breech ring and having open and closed positions; a slide mounted in the breech ring and being guided by the breech ring groove for displacements relative to the breech ring; a connecting element for coupling the slide to the breechblock for causing motion of the breechblock between the open and closed positions by the displacements of the slide; and a control cam rotatably supported in the breech ring. The control cam has a cam track coupled to the slide for effecting displacements of the slide upon rotation of the control cam Further, an external drive is provided for rotating the control cam.

8 Claims, 3 Drawing Sheets

BREECHBLOCK OPENING AND CLOSING DEVICE FOR A LARGE-CALIBER WEAPON

CROSS REFERENCE TO RELATED APPLICATION

This application claims the priority of German Application No. 198 04 653.7 filed Feb. 6, 1998, which is incorporated herein by reference.

BACKGROUND OF THE INVENTION

This invention relates to a large-caliber weapon which has a barrel provided with a breech ring, a breechblock shiftably received therein, as well as a barrel recuperator.

In large-caliber weapons the recuperating motion effected by the barrel recuperator is often also used for opening the breechblock by means of an opener cam, for ejecting the empty propellant case, for arming the firing pin and for again closing the breechblock as soon as a new cartridge has been introduced into the barrel. The barrel recuperator and the breechblock are operatively coupled to one another for performing these functions.

It is a disadvantage of the above-outlined weapons that among others, due to the interconnection between the barrel recuperator, the breech ring and the breechblock by the opener cam, powerful shocks are generated which lead to vibrations and may adversely affect the dispersion pattern of the weapon.

SUMMARY OF THE INVENTION

It is an object of the invention to provide an improved weapon of the above-outlined type in which an opening of the breechblock is possible during the recuperating motion of the barrel without generating shocks which would cause vibration and would adversely affect the dispersion pattern of the weapon.

This object and others to become apparent as the specification progresses, are accomplished by the invention, according to which, briefly stated, the weapon includes a barrel; a breech ring attached to a rearward end of the barrel; a groove provided in the breech ring; a movable breechblock mounted in the breech ring and having open and closed positions; a slide mounted in the breech ring and being guided by the breech ring groove for displacements relative to the breech ring; a connecting element for coupling the slide to the breechblock for causing motion of the breechblock between the open and closed positions by the displacements of the slide; and a control cam rotatably supported in the breech ring. The control cam has a cam track coupled to the slide for effecting displacements of the slide upon rotation of the control cam. Further, an external drive is provided for rotating the control cam.

The invention is based on the principle according to which the opening and closing of the breechblock is effected by an external drive rather than by the force derived from the recuperator. As a result, not only an opening of the breechblock may be effected without impact loads (shocks) of the weapon but also a very uniform opening and closing motion of the breechblock may be ensured. Further, by using an external drive the opening of the breechblock may be timed independently from the motion of the barrel recuperator and may be selected as a function of the cycling of the ammunition supply to the weapon which is a particularly significant advantage in remote-controlled weapons.

According to a preferred embodiment of the invention, the breechblock is connected by means of a traverse with two slides guided laterally in respective vertical grooves at opposite sides of the breech ring. The slides are, in turn, in engagement with respective control cams which are rotatably supported in the breech ring and which are coupled to a common external drive.

To obtain a particularly uniform motion of the breechblock during opening and closing, an eccentrically supported control cam has been found advantageous which engages the inner wall face of the frame-shaped slide.

DESCRIPTION OF THE PREFERRED EMBODIMENT

Figure 1:
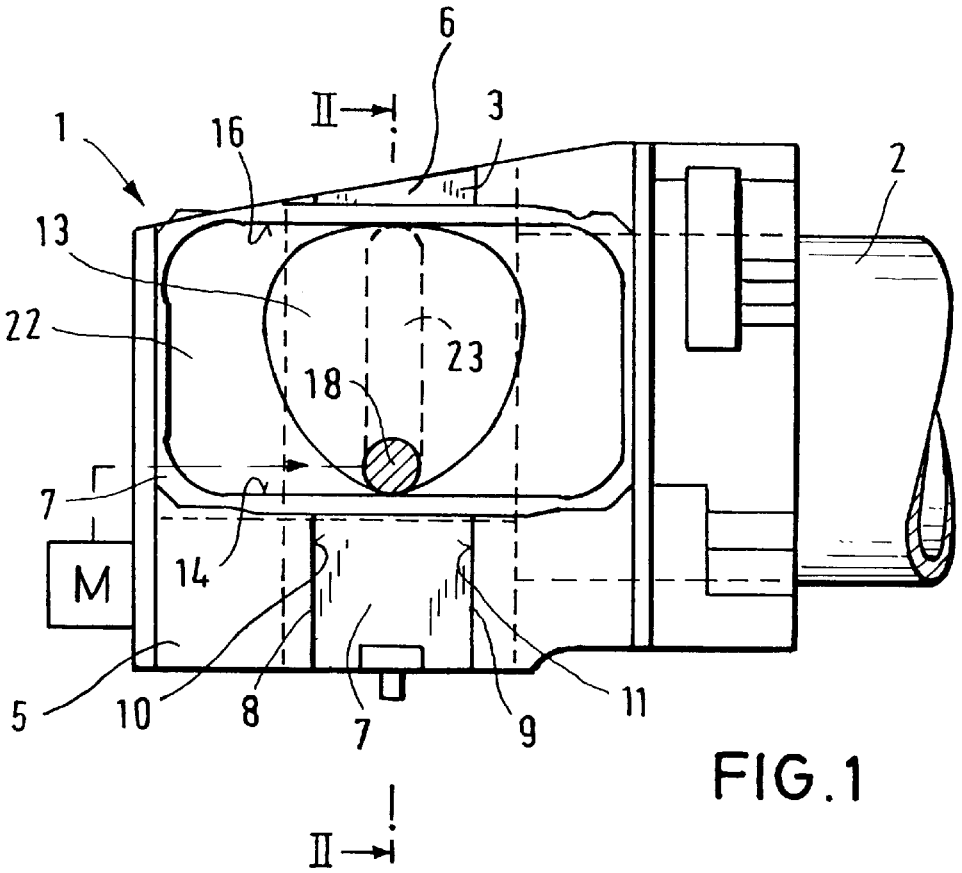
FIG. 1 is a side elevational view of a breech ring and a closed breechblock of a weapon according to the invention.
Figure 2:
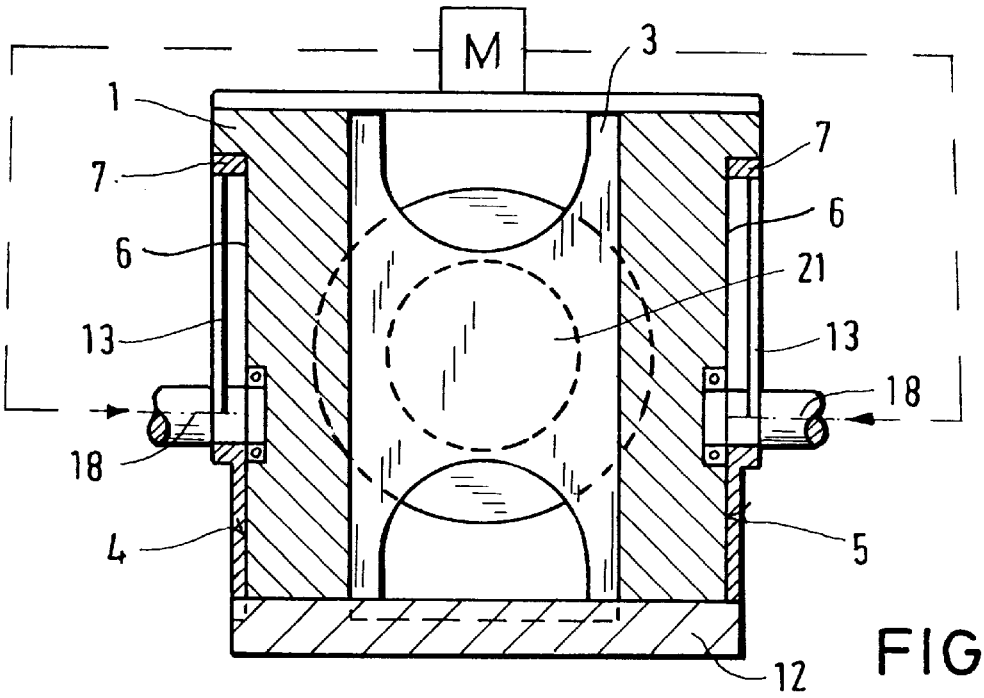
FIG. 2 is a sectional view taken along line II—II of FIG. 1.

FIGS. 1 and 2 show a breech ring 1 of a large-caliber weapon, such as a tank cannon. The breech ring 1 is attached at its front to the rearward end of a weapon barrel 2 and accommodates a conventional breechblock 3 which, in its closed position shown in FIG. 1, closes the breech of the loaded barrel 2. For removing spent cartridge cases and for loading ammunition, the breechblock 3 is slidable vertically in the breech ring 1 to assume an open position as shown, for example, in FIG. 5.

The breech ring 1 has at its opposite side faces 4 and 5 a respective vertical groove 6 in which a frame-shaped slide 7 is slidably arranged. Each groove 6 has lateral guiding side walls 10 and 11 which slidably engage opposite longitudinal edges 8 and 9 of the respective slides 7. The two slides 7 are connected with one another and with the breechblock 3 by means of a connecting member (traverse) 12.

Within the frame portion of each slide 7 a respective control cam (cam disk) 13 is disposed. Each cam disk 13 has a periphery which constitutes a cam track engaging opposite inner edge faces 14 and 16 (follower faces) of the frame portion of the respective slides 7. The cam disks 13 are supported for rotation by eccentric shafts 18 mounted by suitable bearings in the breech ring 1. Further, the two cam disks 13 are connected with an external drive, such as a symbolically illustrated electric motor M which is secured to the breech ring 1. The cam disks 13 are connected with the motor M by a lateral drive stage (not shown) and a common shaft.

In the description which follows, the operation of the above-described breechblock opening device will be set forth.

As a starting point it is assumed that a shot has been fired and the weapon barrel 2 has completed its recoil motion and is, by means of a barrel recuperator which is not shown for the sake of clarity, set in motion in a forward direction. During such an operational phase the chamber 21 of the barrel 2 is closed by the breechblock 3 as shown in FIG. 2. At the same time, the two cam disks 13 are in a open position as they engage the oppositely located inner side wall faces 14 and 16 of the slides 7. The rotary shafts 18 of the cam disks 13 contact the respective wall faces 14 of the slides 7.

At a predetermined position of the weapon barrel 3 during its recuperating motion, the external drive (motor M) is activated and thus turns the two cam disks 13 in a counterclockwise direction as viewed in FIG. 1. Due to the camming action between the respective cam disk 13 and the slide 7, the breechblock 3 is being shifted downwardly. Upon completion of a rotation of 90° of the cam disks 13, the latter engage portions of the inner side walls 14 and 16 as shown in FIGS. 3 and 4, and the breechblock 3 has been lowered, for example, by 90 mm.

Figure 5:
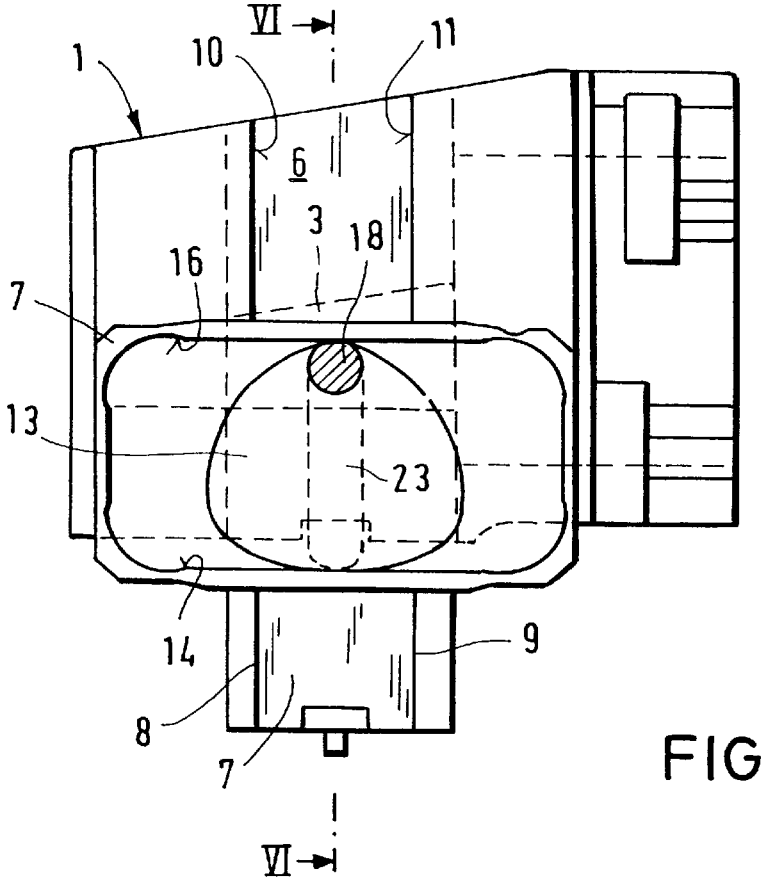
FIG. 5 is a view similar to FIG. 1, showing the breechblock in a fully open position.
Figure 6:
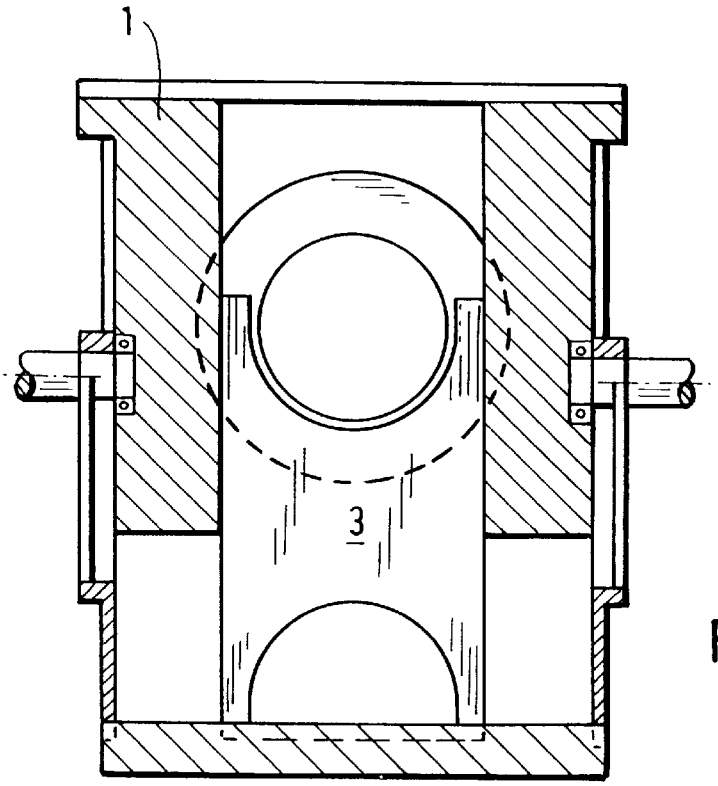
FIG. 6 is a sectional view taken along line VI—VI of FIG. 5.

After the cam disks 13 have completed a 180° rotation, they have shifted the breechblock 3 into its fully open position as shown in FIGS. 5 and 6. In the fully open position of the breechblock 3 an empty cartridge case may be ejected and a new cartridge ammunition may be introduced. The rotary shafts 18 of the cam disks 13 now contact the upper inner side wall 16 of the slides 7.

For closing the breechblock 3, the two cam disks 13 are rotated through an additional 180° by means of the external drive motor M. During such an operational step the weapon barrel 2 and thus the breech ring 1 may be in their position of rest.

Figure 3:
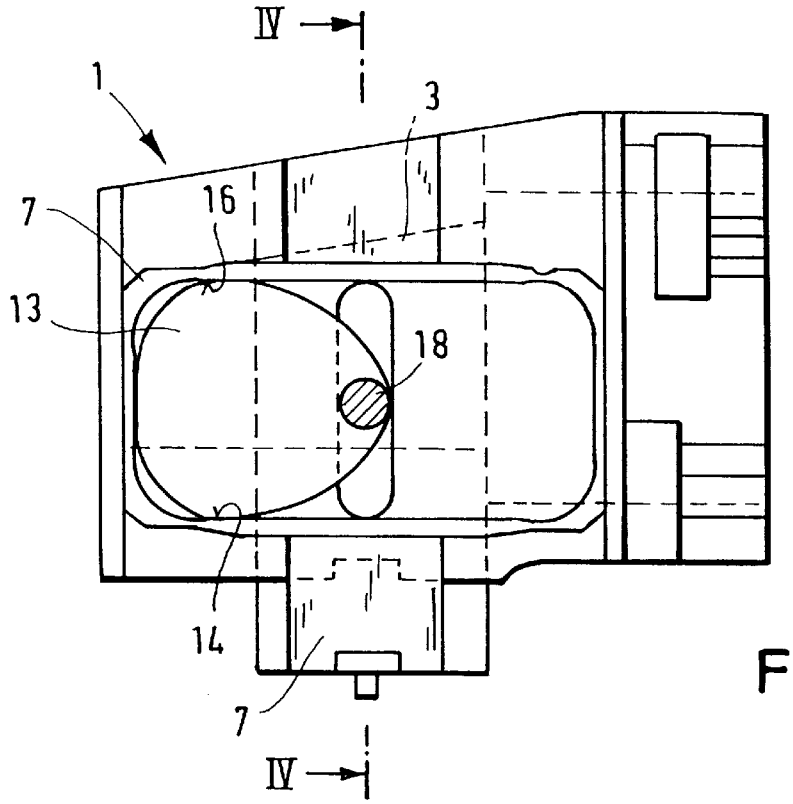
FIG. 3 is a view similar to FIG. 1, showing the breechblock in a partially open position.
Figure 4:
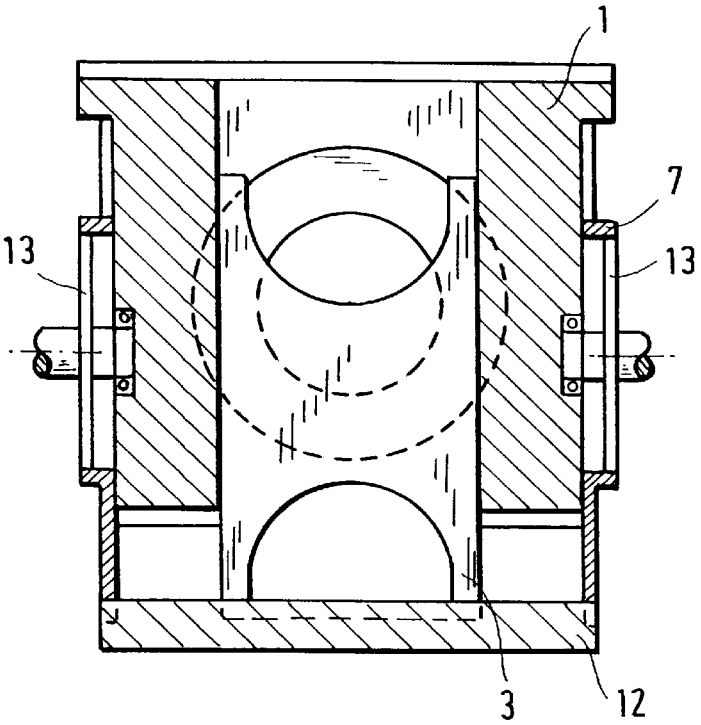
FIG. 4 is a sectional view taken along line IV—IV of FIG. 3.

As it may be observed in FIGS. 1, 3 and 5, it is advantageous to provide the respective slides 7 with a rear wall 22 having a throughgoing vertical slot 23 through which the shaft 18 of the respective cam disk 13 passes. The slot 23 is bordered at it longitudinal ends by the inner side wall faces 14 and 16 of the respective slide 7.

It is to be understood that the invention is not limited to the embodiment described. Thus, for example, it may be sufficient to provide but a single slide arranged on one side of the breech ring. Further, instead of a cam disk, another type of force-transmitting member (control cam) may be used which has a cam track shaped to perform the desired opening and closing motions of the breechblock.

It will be understood that the above description of the present invention is susceptible to various modifications, changes and adaptations, and the same are intended to be comprehended within the meaning and range of equivalents of the appended claims.

What is claimed is:

1. A weapon comprising (a) a barrel;

(b) a breech ring attached to a rearward end of said barrel;

(c) a groove provided in said breech ring;

(d) a movable breechblock mounted in said breech ring and having open and closed positions;

(e) a slide mounted in said breech ring and being guided by said groove for displacements relative to said breech ring;

(f) connecting means for coupling said slide to said breechblock for causing motion of said breechblock between said open and closed positions by the displacements of said slide;

(g) a control cam rotatably supported in said breech ring; said control cam having a cam track coupled to said slide for effecting displacements of said slide upon rotation of said control cam; and (h) an external drive for rotating said control cam.

2. The weapon as defined in claim 1, wherein said cam track is configured such that a 180° rotation of said control cam effects movement of said breechblock from said closed position to said open position thereof.

3. The weapon as defined in claim 1, wherein said groove is oriented vertically.

4. The weapon as defined in claim 1, wherein said slide has a frame portion surrounding said control cam; further wherein said frame portion has an inner surface forming a follower face; said follower face being in contact with said cam track.

5. The weapon as defined in claim 4, wherein said groove and said slide each have two opposite side walls; respective said side walls of said slide being slidably guided by respective said side walls of said groove.

6. The weapon as defined in claim 4, wherein said control cam is an eccentrically supported cam disk having a periphery constituting said cam track; said inner surface of said frame portion having a plurality of wall faces; said cam track of said cam disk simultaneously engaging at least two of said wall faces.

7. The weapon as defined in claim 1, wherein said external drive is an electric motor.

8. A weapon comprising (a) a barrel;

(b) a breech ring attached to a rearward end of said barrel; said breech ring having opposite side faces;

(c) a groove provided in each of said side faces of said breech ring;

(d) a breechblock mounted in said breech ring and having open and closed positions;

(e) separate slides mounted in said breech ring and being guided by said groove of respective said side faces of said breech ring for displacements relative to said breech ring;

(f) connecting means for coupling said slides to one another and to said breechblock for causing motion of said breechblock between said open and closed positions by the displacements of said slides;

(g) two control cams rotatably supported in said breech ring; each said control cam having a cam track in contact with a respective said slide for effecting displacements of said slides upon rotation of said control cams; and (h) a common external drive for rotating said control cams.

* * * * *